US006440265B1

(12) United States Patent
Judd

(10) Patent No.: US 6,440,265 B1
(45) **Date of Patent: *Aug. 27, 2002**

(54) FRP HOOD FOR PAPER PROCESSING PLANT

(75) Inventor: Brian Judd, Birmingham, AL (US)

(73) Assignee: Bonded Fiberglass Company, Birmingham, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/490,841

(22) Filed: Jan. 25, 2000

Related U.S. Application Data

(63) Continuation of application No. 08/985,375, filed on Dec. 4, 1997, now Pat. No. 6,017,416.

(51) Int. Cl.[7] ..... D21C 9/02; D06F 17/00; B01D 33/06; B08B 15/02

(52) U.S. Cl. ..... 162/60; 210/380.3; 210/402; 68/196; 68/139; 454/67; 8/156

(58) Field of Search ..... 162/60, 251; 68/139, 68/196; 210/380.3, 402; 8/156; 118/64; 454/67; 198/637; 29/DIG. 59

(56) References Cited

U.S. PATENT DOCUMENTS

| | | | | | |
|---|---|---|---|---|---|
| 2,291,463 | A | * | 7/1942 | Gerlach | 68/139 |
| 3,454,970 | A | | 7/1969 | Sutherland | 68/45 |
| 4,205,541 | A | | 6/1980 | Zucker | 68/200 |
| 4,545,857 | A | | 10/1985 | Wells | 162/252 |
| 4,616,489 | A | | 10/1986 | Wood et al. | 68/200 |
| 6,017,416 | A | * | 1/2000 | Judd | 162/60 |

FOREIGN PATENT DOCUMENTS

| | | | |
|---|---|---|---|
| WO | WO 90/10109 | * | 9/1990 |

* cited by examiner

*Primary Examiner*—Christopher A. Fiorilla
*Assistant Examiner*—Dionne A. Walls
(74) *Attorney, Agent, or Firm*—Robert M. Jackson; Robert J. Veal; Burr & Forman LLP

(57) ABSTRACT

An improved hood enclosure for isolating wood pulp washing equipment from the ambient environment. The hood has a pair of end members, a pair of skirts along each side to connect to the end member together, and an upper spine also connected at each end to the end members. A pair of clamshell style doors are mounted to the spine along longitudinal hinge lines and are opened vertically. A plurality of access doors are positioned within the skirts, and a plurality of spray or shower pipes penetrate the hood through an end panel to deliver wash liquid to the internal wash drums positioned within the wash vat. Several sealing methods are incorporated to provide sealable access for the access doors, the clamshell doors, and access to the interior of the washing vat for the shower pipes. The clamshell doors abut a peripheral neoprene sealing gasket and are held against the gasket by their own weight. The access doors abut and enclose a raised comb on the hood skirt and an elastomeric closure strap biases the access door against a neoprene gasket positioned along the contact area of the door against the raised comb, thereby sealing the door when closed. At the penetration point of the hood, the washer spray pipes are seated in a saddle flange on one side and a series of half portals correspondingly positioned with saddle flange portals on the other side.

17 Claims, 7 Drawing Sheets

FRP HOOD FOR PAPER PROCESSING PLANT

The present application is a continuation of U.S. patent application Ser. No. 08/985,375, filed Dec. 4, 1997, now U.S. Pat. No. 6,017,416.

FIELD OF THE INVENTION

The present invention relates to stock washers for removing impurities or other substances from a porous mat such as wood pulp. In particular, the present invention relates to hood enclosures for containing volatile chemical emissions from apparatus constructed and arranged for carrying out craft mill washing processes.

BACKGROUND OF THE INVENTION

In a standard paper production line, wood chips are cooked with chemicals in aqueous solution, the precise composition of the cooking chemicals depending upon the desired resultant chemical mixture. The resulting chemical mixture, sometimes referred to as "stock" is composed of wood pulp and liquid containing residual chemical and dissolved woody materials, the liquid portion being commonly referred to in the art as "red or black liquor." Separation of the pulp from the black liquor is normally carried out in a washing operation, after which the wash liquor is evaporated to recover the chemicals contained therein.

The most common type of washer system includes a rotary vacuum drum onto which the stock is spread. The drum is perforated, and a vacuum maintained inside causes the separation of the liquid from the pulp. The pulp assumes the form of a pulp mat which is still impregnated with chemicals and organics. A shower washer is usually positioned above the drum and typically extends axially along the drum and directs water at and through the pulp mat to remove these substances. A typical washing installation may include several washer drums in sequence with wash water being flowed against the flow of pulp movement so that the final washing stage uses clean water. Subsequent washing stages may be required if the washed pulp is to be bleached.

The liquor effluent from the washers comprises water, spent cooking solvents, and organic materials. The cooking solvents consist of sulfates ($SO_2$) held in an aqueous solution, methanol/ODTT, and other toxic contaminants. In addition to the liquid contaminants, airborne contaminants are emitted from the washing process due to the high heat and steam introduced during the washing process.

As is customary in the industry, a hood is placed over the drum and washers to prevent steam from being lost and to protect workers from the washing chemicals. Access portals to the interior of the washing areas are incorporated in the hood structure to enable workers to clean the washing screens and provide general maintenance to the interior of the washer.

Current hood technology employed in the pulp and craft mill industries consists mainly of loose fitting metal covers with downward extending resilient flaps made of neoprene. While present hood technology may adequately protect workers from the hazardous liquid emissions of the washing operation, contemporary hoods do little or nothing to reduce exhaust gases which contain airborne chemical and toxic contaminants. Also, present hoods do not provide a means for establishing a negative hood pressure within the wash area to control out-gassing of contaminants and process evaporation.

As part of current environmental pollution controls, pulp mills incinerate toxic off-gases evacuated from their washing operations so that they can comply with EPA regulations. This incineration process necessitates that pulp mills incur additional manufacturing expense in the form of fuel consumption to incinerate the toxic gases. However, the EPA is moving toward more stringent regulations for paper mills; partly to encourage oxygen delignification (OD) implementation, which significantly reduces water usage and the emission of chlorinated pollutants to the atmosphere during the bleaching operation. Present gas incineration strategies will not provide sufficient pollution reductions to meet the new EPA standards. Furthermore, the published EPA goal for craft mills is a "closed mill" design with zero water discharge. In order for craft mills to meet the new EPA regulations soon to be promulgated, current hood technology must be improved to enclose pulp washers and contain the steam and vapor emissions. An additional benefit to the implementation of new hood technology will be to significantly reduce or eliminate the fuel costs for off-gassing incineration, as well as avoidance of EPA fines.

Therefore, there is a great need in the pulp mill industry for an improved hood enclosure that will permit maintenance access and the passage of various types of conduits into the interior of the washing unit while minimizing the emission of toxic substances into the environment. The hood must also be economical and resistant to the caustic chemicals used in washing systems.

SUMMARY OF THE INVENTION

It is the object of the present invention to provide a hood enclosure to cover and reduce the gaseous emissions from a pulp processing washing systems while maintaining a negative internal pressure within the wash system.

It is another object of the present invention to provide an economical and chemically resistant hood enclosure fabricated from Fiber Reinforced Plastic (FRP).

It a further object of the present invention to provide durable, renewable sealing methods for routine and overhaul maintenance access features as well as process and equipment penetrations from the washing system within the enclosure.

Briefly, the hood enclosure has a pair of end members, skirts along each side connect to the end members, and an upper spine connected at each end to the end members. A pair of clamshell style doors are mounted to the spine along longitudinal hinges and are opened vertically. A plurality of access doors are positioned within the skirts, and a plurality of spray or shower pipes penetrate the hood through an end panel to deliver wash liquid to the internal wash drums. Several sealing methods provide sealable access for the access doors, the clamshell doors, and the shower pipes to the interior area of the hood. Such sealing strategies include a peripheral neoprene gasket that abuts the clamshell doors, a raised comb on the hood skin having a U-seal and an elastomeric closure strap to bias access doors against the U-seal, and a saddle flange having a series of PET half rings correspondingly positioned with portals on an upper panel to receive a plurality of shower pipes that penetrate the hood. The pipes are further secured and sealed by a U-bolt which is seated in a groove in the PET half-rings and bolted to a continuous flange on the interior of the saddle flange. Neoprene gaskets backup the PET rings such that gaseous emissions are eliminated.

Other features and objects and advantages of the present invention will become apparent from a reading of the following description as well as a study of the appended drawings.

BRIEF DESCRIPTION OF THE DRAWINGS

A hood enclosure incorporating the features of the invention is depicted in the attached drawings which form a portion of the disclosure and wherein.

DESCRIPTION OF THE PREFERRED EMBODIMENT

Figure 1:
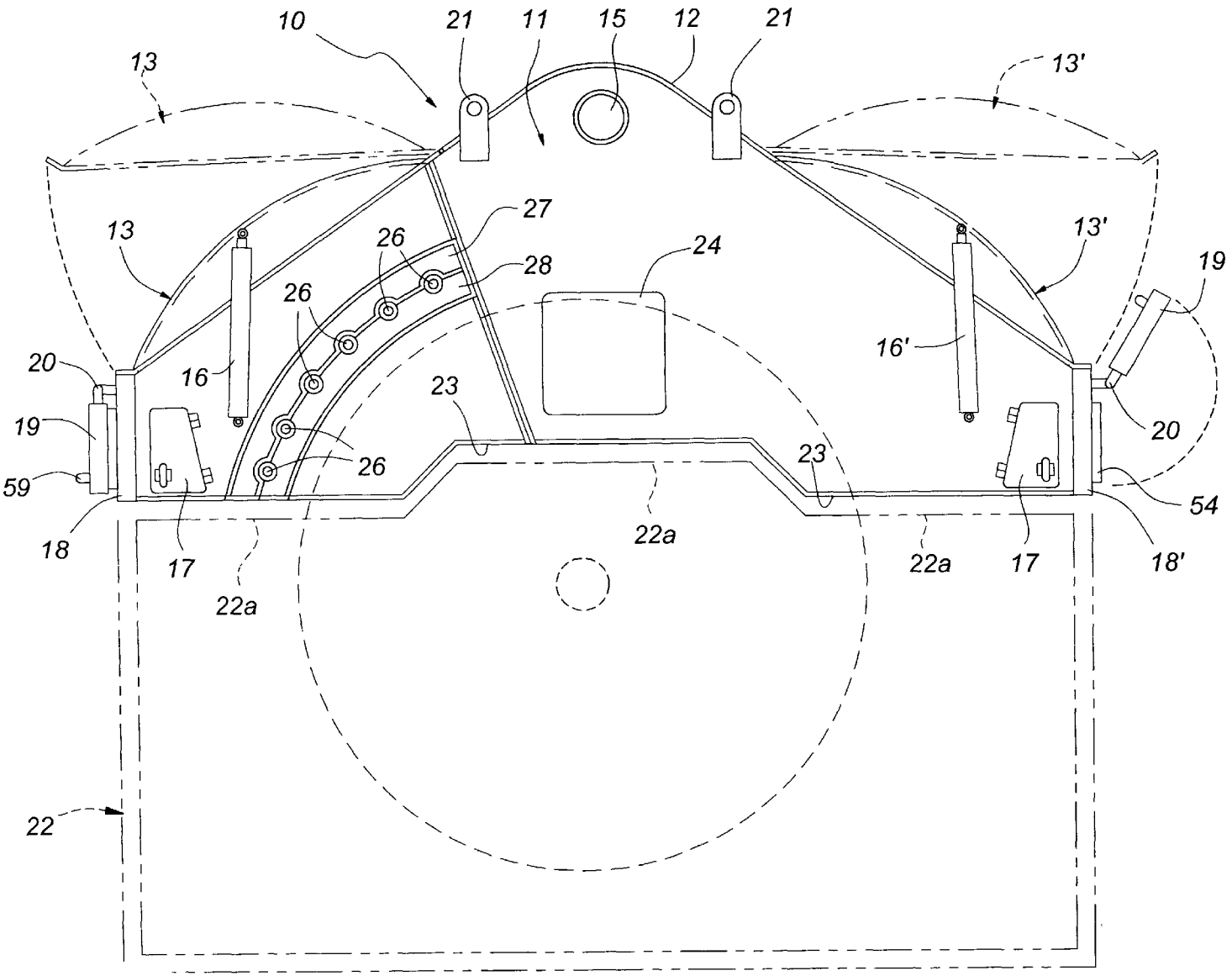
FIG. 1 is an elevational view of an end of the hood enclosure showing the shower pipe penetrations and the clamshell doors movable to an open position.
Figure 2:
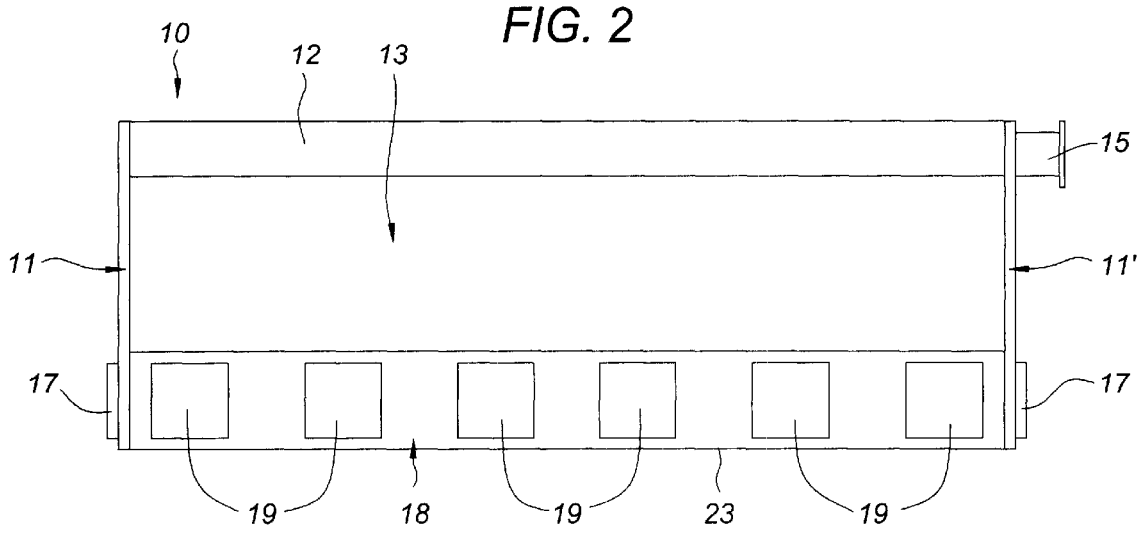
FIG. 2 is side elevational view of the hood enclosure showing the low leakage access doors and the clamshell doors.
Figure 3:
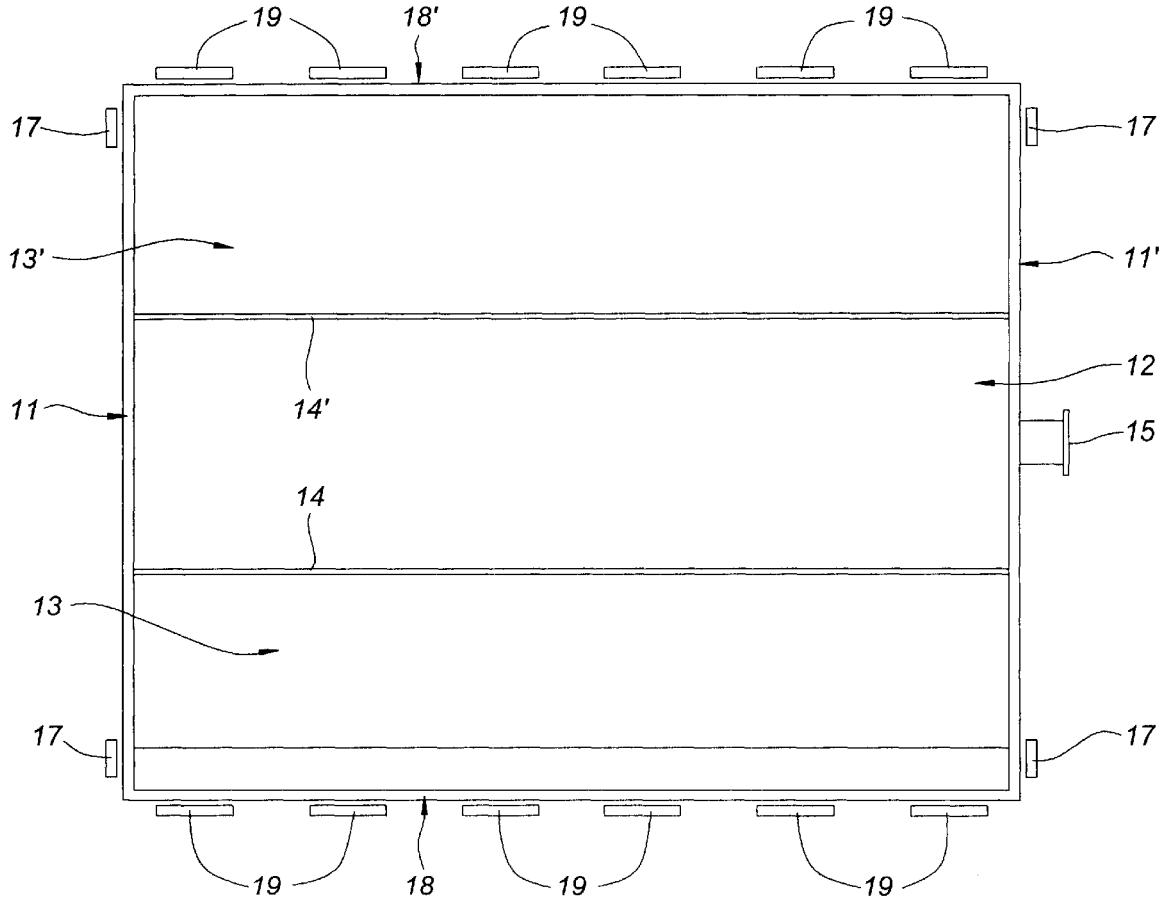
FIG. 3 is a plan view of the hood enclosure.
Figure 4:
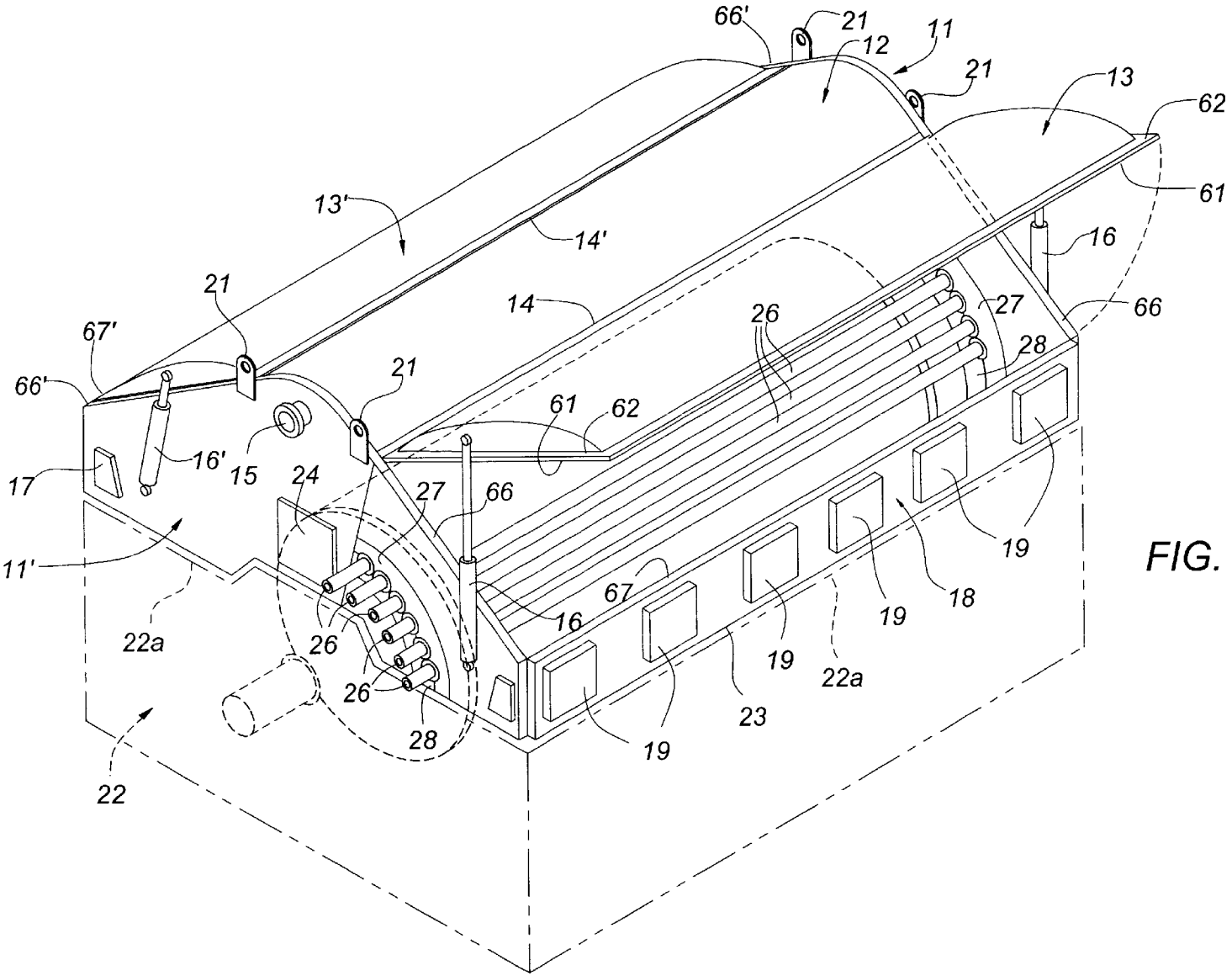
FIG. 4 is a perspective view of the entire hood enclosure.

Referring to the drawings for a better understanding of the function and structure of the invention, the enclosure 10 is fabricated from Fiber Reinforced Plastic (FRP) in sections in accordance with the shape and dimensions of washing equipment selected to be enclosed. Upon fabrication, these sections are then bolted or riveted together at overlapping flange areas and sealed with a silicon based sealant or other suitable sealant. In this manner, various configurations of hood enclosures may be constructed with various types of features such as hoods, doors, and removable access panels. Accordingly, various types of seals need to be introduced between panel sealing flanges of the hood features such as "P-strip" seals or "U-strip" seals with additional neoprene edge strips to seal the incorporated hood features.

Figure 8:
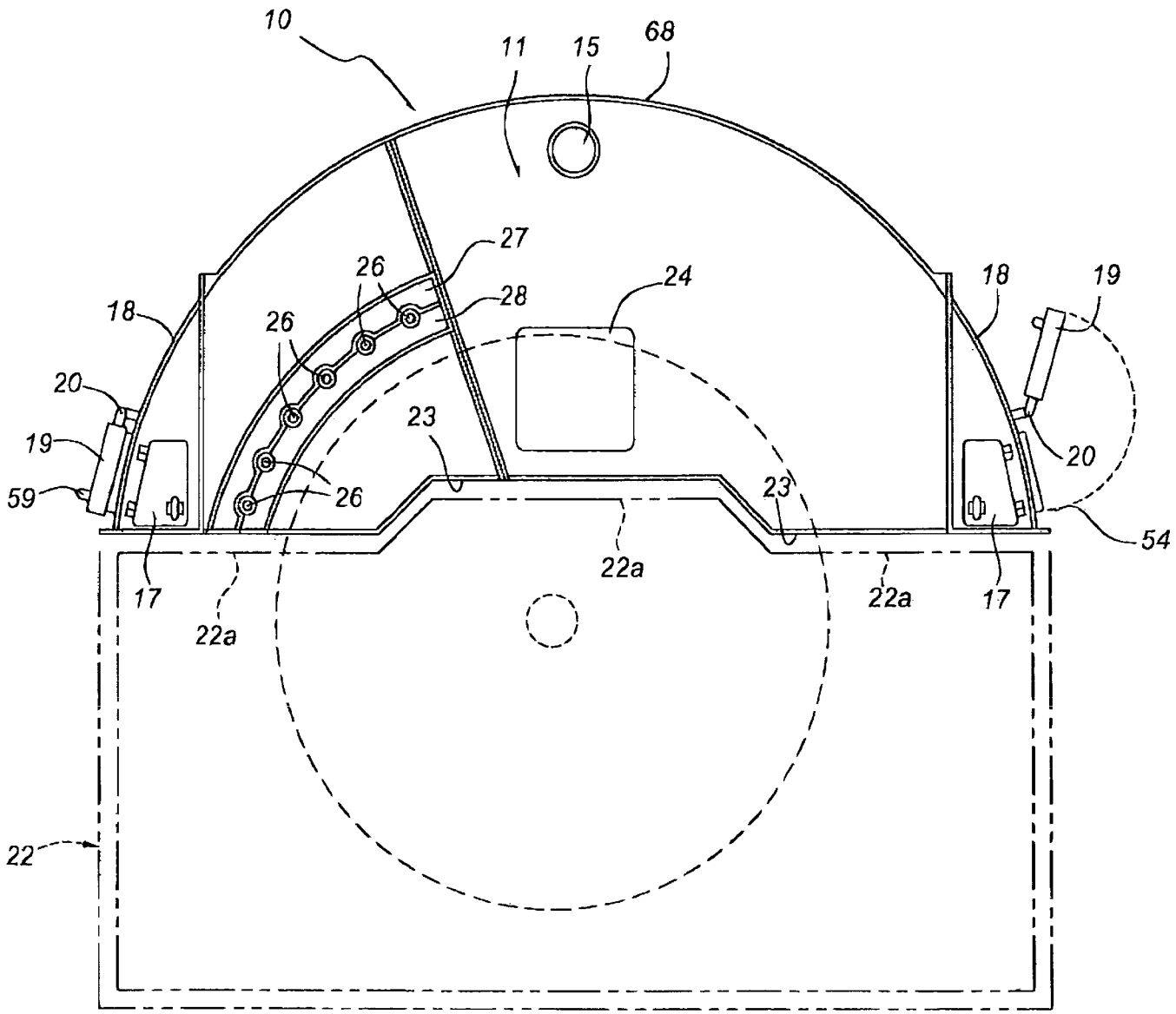
FIG. 8 is an end view of a second embodiment of the invention.

Referring to FIGS. 1, 2, 3, and 4, it may be seen that hood enclosure 10 includes two end panels 11,11' that are connected by an upper spine member 12 that runs the entire length of the hood enclosure 10. Clamshell doors 13,13' are hinged to the upper spine 12 at 14,14' and linear actuators 16,16' serve as individual lifting mechanisms for the doors 13,13' and for maintaining them in a closed position of an open position as shown in FIG. 1. The hinges 14,14' run the length of the spin 12 so that full access to the washing drums and other washing vat equipment is provided upon moving the doors to an open position. While two clamshell doors are shown, it is contemplated that a closed panel may replace both or either of these doors, depending upon the configuration of the hood enclosure 10. Two skirts 18,18' extend downwardly from the clamshell doors 13,13' and connect end panels 11,11' along their lower portions. As shown, the downwardly extending skirts extend linearly toward the vat 22 (shown in phantom). However, the skirts 18,18' could alternatively extend in an angled or arcuate manner to the upstanding vat periphery 22 as shown in FIG. 8. A plurality of maintenance access doors 19 are positioned in the skirts 18,18' as is more clearly seen in FIG. 2, and access door 24 provides further access to the interior of the hood 10 through the end panel 11. Sample/Flood relief doors 17 allow limited side access to the interior of the enclosure and provide flood overflow relief.

Enclosure 10 has a general overall shape similar in appearance to a half cylinder. Lifting lugs 21 are positioned at various points on the hood enclosure for lifting and transport to a pulp mill for installation over washing equipment, and exhaust ports 15 located at or near the upper spine 12 are included in the event that gases and vapors must be evacuated from within the hood 10. In order to increase the structural integrity of the hood and to make assembled transport feasible, various sized panel flanges, parabolic stiffeners, and blade stiffeners are integrated into the various panels of the hood as is well known in the art. As shown in phantom in FIGS. 1, 2, and 4, the entire hood 10 would be positioned upon a generally rectangular vat 22 within which are positioned various sorts of washing equipment. A flange 23 on the bottom periphery of the hood 10 supports the hood on the vat 22 after lowering, and appropriate sealants are interposed between the flange 23 and a mating flange 22*a* on vat 22 during the installation procedure to seal the hood 10 upon the vat 22.

Referring to FIGS. 1 and 4 again, shower pipes 26 are displaced longitudinally of the washer. Lower end wall 25 is positioned beneath the shower pipes. Lower panel 28 is constructed to act as a saddle flange mated to lower end wall 25 into which shower pipes are seated and secured. Upper panel 27 is formed to mate with saddle flange 28 to circumscribe shower pipes 26 in semicircular portals. End wall 25, upper panel 27, and lower panel 28 are secured into the hood 10 with a plurality of bolts and sealed along their respective connecting flanges as with the other connected panels of the hood.

Figure 7:
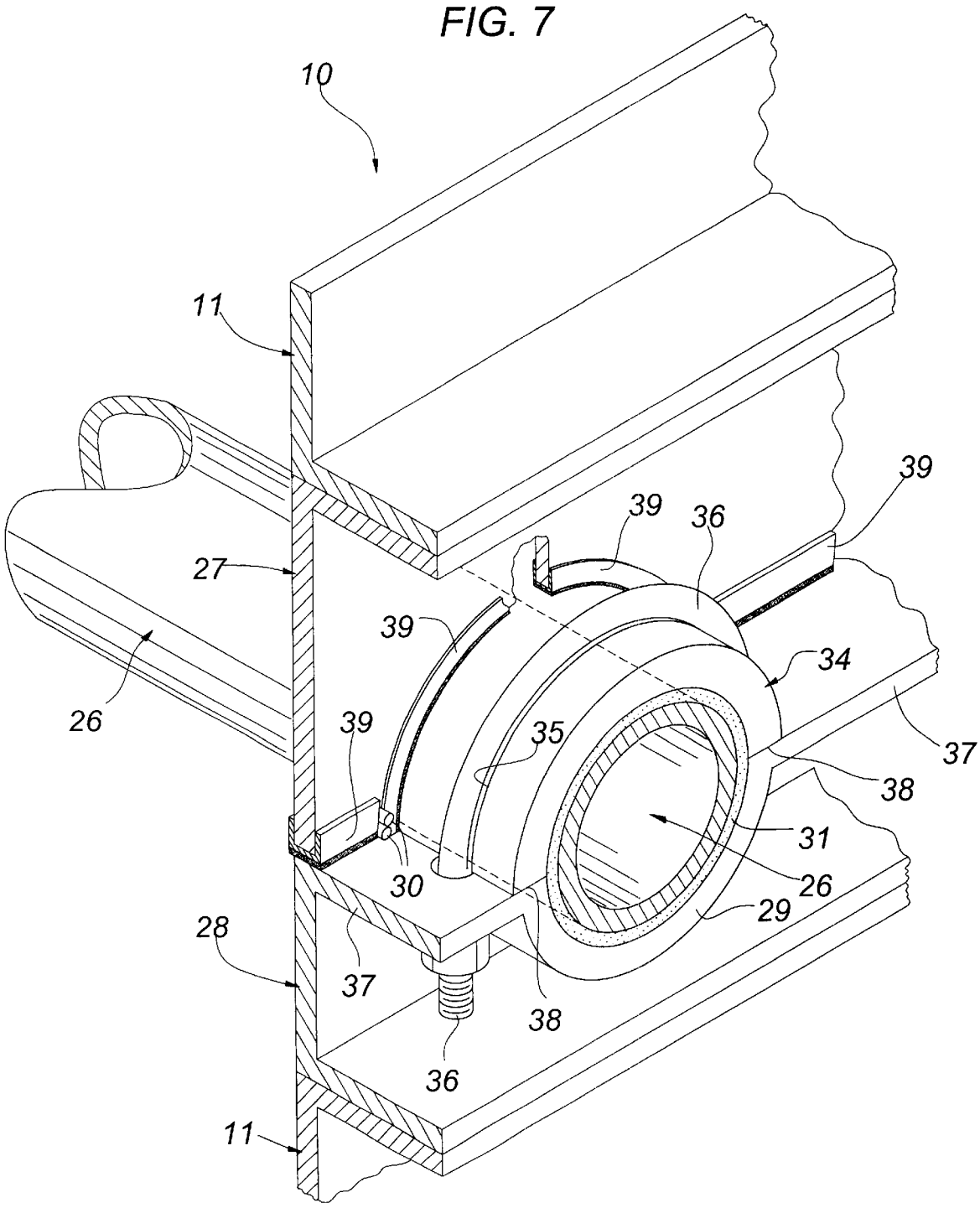

FIG. 7 shows the detailed sealing features of the upper 27 and lower 28 shower panels as viewed from the interior of the hood. Saddle flange 28 has formed therein a plurality of semicircular half portals 29 generally corresponding to the diameter of a shower pipe 26. Each shower pipe 26 is seated within a corresponding saddle flange portal and each has a gasket 31 interposed therebetween for sealing purposes. The upper shower panel 27 is formed to include a series of half portals 33 of a diameter greater than the diameter of the portals 29 of the saddle flange, but cooperatively positioned above each saddle flange portal. Each of the portals of upper panel 27 includes a PET half ring 34 which acts as a pillow block to conform to and hold the pipes in place. The PET pillow block 34 extends around half of the shower pipe 26 and contacts and is seated against the saddle flange 28 at 38. Gasket 31 extends around the entire pipe to seal the saddle flange and the pillow block 34 around the shower pipe 26. A silicone sealant may also be used in this interstice.

Each PET pillow block 34 includes a groove 35 cooperatively sized to receive a U-bolt 36. The U-bolt 36 is positioned around the groove 35 and bolted through flange 37 which is integral to the interior of saddle flange 28. Upon tightening the U-bolt 36, pillow block 34 biases shower pipe 26 against saddle flange 28 thereby sealing it to the hood. The upper panel 27 is cooperatively positioned over the pillow block 34 such that the half portals 33 encompass the pillow blocks 34. In order to adequately seal each PET pillow block 34 against the upper panel 27, a plastic encapsulated metal U-strip 39 having a neoprene seal affixed at a lower contact point is positioned over the lower edge of the half portal 33 as shown. Provided that the trimmed upper panel 27 causes U-strip seal 39 to sufficiently bear against the pillow block 34, seal 39 will seal the upper panel 27 to the block 34 and prevent any vapors or gases from escaping the enclosure. During fitting of the upper panel 27 into the hood, the panel 27 may have its connecting flange 41 selectively positioned against the end panel connecting flange 42 such that U-strip seal 39 will contact the PET pillow block 34 at various locations. For example, after positioning of the upper panel 27, the seal 39 may bear along the length of the U-bolt 36, against the pillow block 34 on the interior side (relative to the interior of the hood enclosure 10) of the U-bolt 36, or against the pillow block 34 on the exterior side of the U bolt 36 (as shown). Each configuration will provide satisfactory sealing results. At any intersection of the edge of seal 39 with a flange, secondary plugs 30 may be inserted to seal any gaps.

Figure 5:
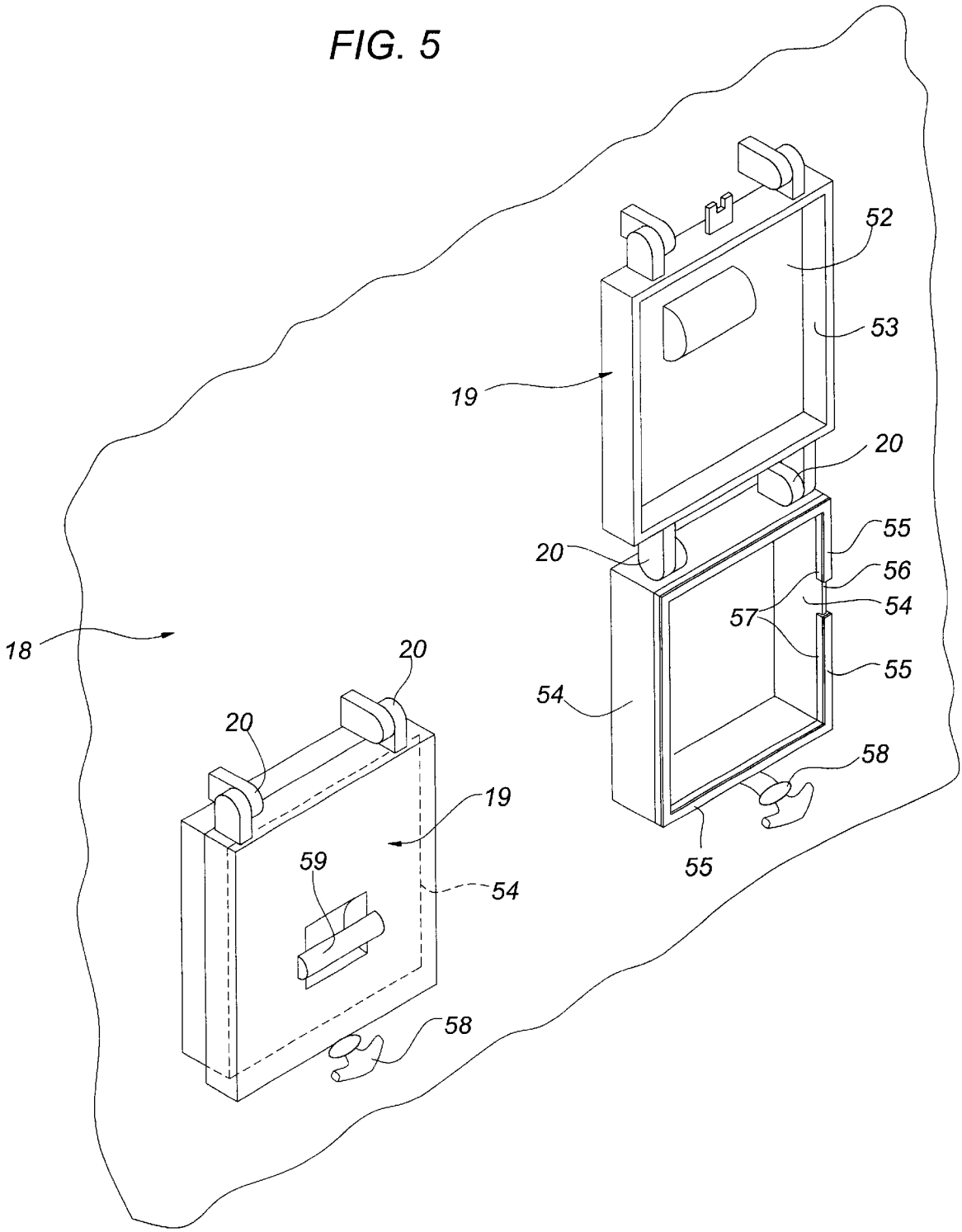
FIG. 5 is a perspective view partially in section of an access door and showing its sealing components.

Maintenance access into the interior of the enclosure 10 is accomplished by positioning a plurality of access doors 19 within skirts 18,18'. Referring to FIG. 5 it may be seen that access door 19 is supported on exterior FRP hinges 20 so that door 19 can swing freely from a closed position to an open position. The door 19 has a smooth recessed mating surface 52 and a skirt 53 which extends around the periphery of the door. Hood skirt 18 includes a raised comb portion 54 with an upper contact edge 56 that works in cooperation with the door 19 upon closure. A plastic encapsulated metal U-strip 57 having a neoprene seal 55 affixed on its upper surface is positioned over upper contact edge 56 of the raised comb 54. Upon closure of the access door 19, the neoprene seal 55 contacts the recessed mating surface 52 on the door the and an elastomeric strap 58 biases the mating surface 52 against the contact edge 56 and seal 55, thereby sealing the access door 19 against the hood skirt 18. Handle 59 has a recessed handhold to facilitate movement of the door.

Figure 6:
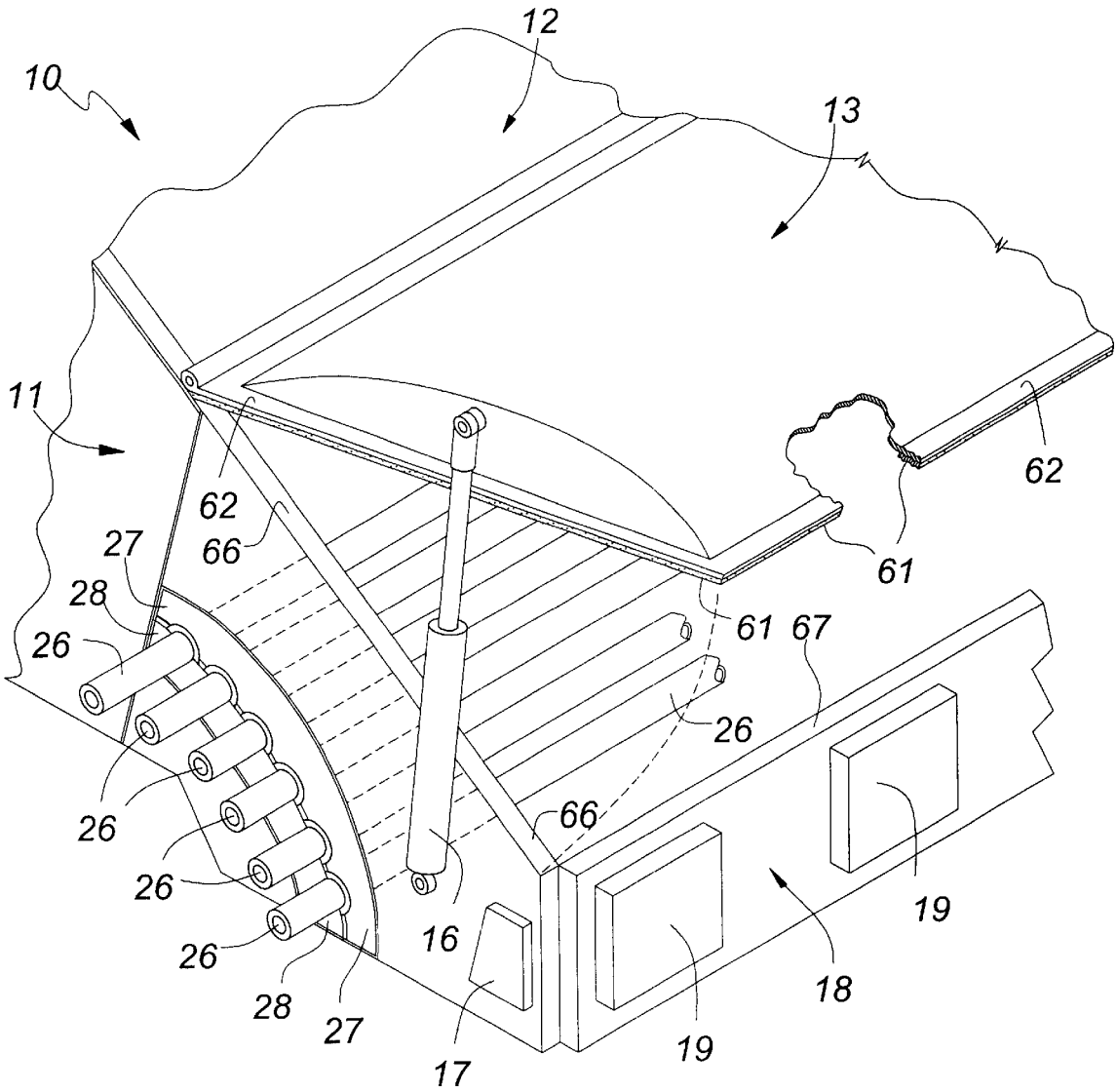
FIG. 6 is a perspective view partially in section of a clamshell door and showing its sealing components; and, FIG. 7 is an internal perspective view partially in section of a shower pipe penetrating the hood and its accompanying sealing components.

Similarly to the access door 19 sealing means, clamshell doors 13, 13' have a neoprene gasket 61 around a peripheral margin 62 of each door 13,13' as seen in FIG. 6. Upon closure of a clamshell door on hood 10, the weight of the door compresses and flattens gasket 61 against the hood at upper connecting flanges 66, 66' of end panels 11,11', and against upper connecting flanges 67,67' of skirts 18,18' such that the door is sealed to the hood 10. Alternatively, a P-strip may be affixed to the hood on the contact area of the clamshell doors or on appropriate connecting flanges of the end panels or skirts to adequately seal the clamshell doors to the hood when closed.

While I have shown my invention in one form, it will be obvious to those skilled in the art that it is not so limited but is susceptible of various changes and modifications without departing from the spirit thereof.

Having set forth the nature of the present invention, what is claimed is:

1. In a wood chip processing apparatus having a vat, a rotating drum positioned within said vat, and a plurality of shower pipes positioned above said drum and extending outside of said processing apparatus, an improved corrosion resistant hood enclosure for reducing the introduction of hazardous pollutants into the environment from said processing apparatus by facilitating the maintenance of a negative pressure within said hood enclosure, comprising two end members, an upper spine connected at each end to said end members, a pair of skirts extending between said end members on opposite sides of said spine, said skirts defining therein access portals sealalby covered by access doors, and at least one clamshell door hingedly connected to said hand enclosure and positioned between said spine and one of said skirts, said hood enclosure including means interspersed between said shower pipes and said bond enclosure for providing sealed passage of said shower pipes through said hood enclosure.

2. A hood enclosure as recited in claim 1, wherein said means for providing sealed passage of said shower pipes comprises:

a. a first elongated member having a saddle flange on one side, said flange defining a plurality of lower half portals;

b. a second elongated member having one side opposing said saddle flange, said opposing side including a plurality of upper half portals correspondingly positioned with said plurality of lower portals such that a plurality of complete portals are formed, and wherein each of said plurality of complete portals receives one of said shower pipes there through;

c. means for urging said pipes against said saddle flange;

d. conforming means interspersed between said means for urging said shower pipes; and, e. sealing means interposed between said conforming means and said second member for sealing said conforming means to said second member.

3. A hood enclosure as recited in claim 2 further including at least one raised comb defining an access area into said vat, said comb having an upper contact edge, and wherein said hood enclosure access door means comprises:

a. an access door hingedly affixed to said hood enclosure and movable to an open position and a closed position, said door having a recessed mating surface, a peripheral margin, and a skirt extending orthogonally from said peripheral margin such that said upper edge contacts said mating surface and said comb is substantially enclosed within said peripheral skirt when said door is moved to said closed position;

b. sealing means affixed to said upper contact edge for sealing said access area upon moving said door to said closed position; and c. means for biasing said door against said comb when in said closed position.

4. In a wood chip processing apparatus having a vat, a rotating drum positioned within said vat, and a plurality of shower pipes positioned above said drum and extending outside of said processing apparatus, an improved fiber reinforced glass hood enclosure for reducing the introduction of hazardous pollutants into the environment from said processing apparatus by facilitating maintenance of a negative pressure within said enclosure, comprising two end members, an upper spine connected at each end to said end members, a pair of skirts extending between said end members on opposite sides of said spine, at least one door defined hingedly affixed to one of said end members of said enclosure and sealably mounted thereto and at least one clamshell door hingedly connected to said hood enclosure and positioned between said spine and one of said skirts, said hood enclosure including sealing means interspersed between said clamshell door and said hood enclosure for sealing said clamshell door against said hood enclosure upon closure.

5. A hood enclosure as recited in claim 4, wherein said means for sealing said clamshell door against said hood enclosure comprises a raised neoprene gasket positioned along a peripheral margin of said clamshell door such that said gasket bears against said hood enclosure upon closure thereon.

6. A hood enclosure as recited in claim 4, further including means interspersed between said shower pipes and said hood enclosure for providing sealed passage of said shower pipes through said hood enclosure.

7. A hood enclosure as recited in claim 6, wherein said means for providing sealed passage of said shower pipes comprises:

a. a first elongated member having a saddle flange on one side, said flange defining a plurality of lower half portals;

b. a second elongated member having one side opposing said saddle flange, said opposing side including a plurality of upper half portals correspondingly positioned with said plurality of lower portals such that a plurality of complete portals are formed, and wherein each of said plurality of complete portals receives one of said shower pipes there through;

c. means for urging said pipes against said saddle flange;

d. conforming means interspersed between said means for urging said shower pipes; and, e. sealing means interposed between said conforming means and said second member for sealing said conforming means to said second member.

8. In a wood chip processing apparatus having a vat, a rotating drum positioned within said vat, and a plurality of shower pipes positioned above said drum and extending outside of said processing apparatus, the improvement comprising: an improved chemically resistant hood enclosure mounted to said vat and sealed thereto to reduce the introduction of hazardous pollutants into the environment from said processing apparatus by facilitating a negative internal pressure within the wash system, comprising two end members, a closed panel assembly connected at each end to said end members, a pair of skirts extending between said end members on opposite sides of said closed panel, said hood enclosure including seals interspersed between said shower pipes and said hood enclosure for providing sealed passage of said shower pipes through said hood enclosure; access doors formed in said skirts for providing sealed access into said vat; and, seals interspersed between said access doors and said hood enclosure for sealing said access doors against said skirts upon closure.

9. A hood enclosure as recited in claim 8, wherein said means for providing sealed passage of said shower pipes comprises:

a. a first elongated member having a saddle flange on one side, said flange defining a plurality of lower half portals;

b. a second elongated member having one side opposing said saddle flange, said opposing side including a plurality of upper half portals correspondingly positioned with said plurality of lower portals such that a plurality of complete portals are formed, and wherein each of said plurality of complete portals receive one of said shower pipes there through;

c. means for urging said pipes against said saddle flange;

d. conforming means interspersed between said means for urging said shower pipes; and, e. sealing means interposed between said conforming means and said second member for sealing said conforming means to said second member.

10. A hood enclosure as recited in claim 9, further including at least one raised comb defining an access area into said vat, said comb having an upper contact edge, and wherein said hood enclosure access door means comprises:

a. an access door hingedly affixed to said hood enclosure and movable to an open position and a closed position, said door having a recessed mating surface, a peripheral margin, and a skirt extending orthogonally from said peripheral margin such that said upper edge contacts said mating surface and said comb is substantially enclosed within said peripheral skirt when said door is moved to said closed position; and b. means for biasing said door against said comb when in said closed position.

11. A hood enclosure as recited in claim 10, wherein said means for sealing said access door against said skirt comprises a raised neoprene gasket interstially positioned between said access door and said raised comb such that said gasket is compressed there between upon closure of said access door.

12. A hood enclosure as recited in claim 8, further including at least one raised comb defining an access area into said vat, said comb having an upper contact edge, and wherein said hood enclosure access door means comprises:

a. an access door hingedly affixed to said hood enclosure and movable to an open position and a closed position, said door having a recessed mating surface, a peripheral margin, and a skirt extending orthogonally from said peripheral margin such that said upper edge contacts said mating surface and said comb is substantially enclosed within said peripheral skirt when said door is moved to said closed position;

b. sealing means affixed between said upper contact edge and said access door for sealing said access area upon moving said door to said closed position; and, c. means for biasing said door against said comb when in said closed position.

13. In a wood chip processing apparatus having a vat, a rotating drum positioned within said vat, and a plurality of shower pipes positioned above said drum and extending outside of said processing apparatus, an improved chemically resistant hood enclosure for reducing the introduction of hazardous pollutants into the environment from said processing apparatus by facilitating the maintenance of a negative pressure in said vat, comprising two end numbers, a closed panel assembly connected at each end to said end members, a pair of skirts extending between said end members on opposite sides of said closed panel assembly, said hood enclosure including means interspersed between said shower pipes and said hood enclosure for providing sealed passage of said shower pipes through said hood enclosure, further including access door means formed in at least one of said skirts in said hood enclosure for providing sealed access into said vat.

14. A hood enclosure as recited in claim 13, wherein said means for providing Sealed passage of said shower pipes comprises:

a. a first elongated member having a saddle flange on one side, said flange defining a plurality of lower half portals;

b. a second elongated member having one side opposing said saddle flange, said opposing side including a plurality of upper half portals correspondingly positioned with said plurality of lower portals such that a plurality of complete portals are formed, and wherein each of said plurality of complete portals receive one of said shower pipes there through;

c. means for urging said pipes against said saddle flange;

d. conforming means interspersed between said means for urging said shower pipes; and, e. sealing means interposed between said conforming means and said second member for sealing said conforming means to said second member.

15. A hood enclosure as recited in claim 13 further including at least one raised comb defining an access area into said vat, said comb having an upper contact edge, and wherein said hood enclosure access door means comprises:

a. an access door hingedly affixed to said hood enclosure and movable to an open position and a closed position, said door having a recessed mating surface, a peripheral margin, and a skirt extending orthogonally from said peripheral margin such that said upper edge contacts said mating surface and said comb is substantially enclosed within said peripheral skirt when said door is moved to said closed position;

b. sealing means affixed between said upper contact edge and said access door for sealing said access area upon moving said door to said closed position; and, c. means for biasing said door against said comb when in said closed position.

16. In a wood chip processing apparatus having a vat, a rotating drum positioned within said vat, and a plurality of shower pipes positioned above said drum and extending outside of said processing apparatus, an improved hood enclosure for reducing the introduction of hazardous pollutants into the environment from said processing apparatus, comprising two end members, a rigid upper panel assembly, a pair of skirts extending between said end members on opposite sides of upper panel assembly, said hood enclosure including access door means formed in at least one of said skirts in said hood enclosure for providing sealed access into said vat.

17. A hood enclosure as recited in claim 16, further including at least one raised comb defining an access area into said vat, said comb having an upper contact edge, and wherein said hood enclosure access door means comprises:

a. an access door hingedly affixed to said hood enclosure and movable to an open position and a closed position, said door having a recessed mating surface, a peripheral margin, and a skirt extending orthogonally from said peripheral margin such that said upper edge contacts said mating surface and said comb is substantially enclosed within said peripheral skirt when said door is moved to said closed position;

b. sealing means affixed between said upper contact edge and said access door for sealing said access area upon moving said door to said closed position; and, c. means for biasing said door against said comb when in said closed position.

* * * * *